US009606508B2

(12) United States Patent
Yoshida

(10) Patent No.: US 9,606,508 B2
(45) Date of Patent: Mar. 28, 2017

(54) ELECTRONIC TIMEPIECE AND METHOD FOR CORRECTING CALENDAR OF ELECTRONIC TIMEPIECE

(71) Applicant: SEIKO EPSON CORPORATION, Tokyo (JP)

(72) Inventor: Hiroaki Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/166,361

(22) Filed: May 27, 2016

(65) Prior Publication Data

US 2016/0378063 A1 Dec. 29, 2016

(30) Foreign Application Priority Data

Jun. 26, 2015 (JP) ..... 2015-128504

(51) Int. Cl.
*G04B 19/24* (2006.01)

(52) U.S. Cl.
CPC ..... *G04B 19/24* (2013.01); *G04B 19/241* (2013.01)

(58) Field of Classification Search
CPC .... G04B 19/24; G04B 19/241; G04B 19/243; G04B 19/2432
See application file for complete search history.

(56) References Cited

U.S. PATENT DOCUMENTS 5,184,333 A * 2/1993 Caspar ..... G04B 19/24 368/28
5,473,580 A * 12/1995 Gilomen ..... G04C 3/146 368/110
6,272,076 B1 8/2001 Dinger
8,264,914 B2 9/2012 Baba
2009/0274010 A1* 11/2009 Vuilleumier ..... G04B 19/268 368/18
2011/0205855 A1* 8/2011 Salzmann ..... G04C 9/00 368/185

FOREIGN PATENT DOCUMENTS

| | | | |
|---|---|---|---|
| EP | 2506094 | A1 | 10/2012 |
| JP | 62-046285 | A | 2/1987 |
| JP | 06-058393 | U | 8/1994 |
| JP | 06-300864 | A | 10/1994 |
| JP | 2000-065958 | A | 3/2000 |
| JP | 2000-147157 | A | 5/2000 |
| JP | 2011-064486 | A | 3/2011 |
| JP | 2012-215563 | A | 11/2012 |

* cited by examiner

*Primary Examiner* — Vit W Miska
(74) *Attorney, Agent, or Firm* — Global IP Counselors, LLP

(57) ABSTRACT

An electronic timepiece includes a second hand, a dial having a display area provided with a plurality of markings corresponding to the second hand, and a display controller that controls driving operation of the second hand to cause the second hand to display calendar information. The display area, when viewed from a timepiece front side, is divided by two straight lines that pass through a rotating shaft of the second hand and are perpendicular to each other into four divided areas. Each of the divided areas is related to years elapsed since a leap year, and each of the markings is related to the month. The display controller, when causing the second hand to display the calendar information, causes the second hand to point at one of the markings in one of the four divided areas to display the elapsed years and the month.

7 Claims, 5 Drawing Sheets

ELECTRONIC TIMEPIECE AND METHOD FOR CORRECTING CALENDAR OF ELECTRONIC TIMEPIECE

BACKGROUND

1. Technical Field

The present invention relates to an electronic timepiece that displays calendar information and a method for correcting the calendar of the electronic timepiece.

2. Related Art

There is a known timepiece of related art that uses indicating hands that display time to display calendar information (see JP-A-2000-147157, for example).

In the timepiece described in JP-A-2000-147157, when a display mode switch that is a crown is so operated as to switch a display mode from a time display mode to a calendar display mode, the second hand points at one of the positions of the seconds that are integer multiples of 5 seconds (5 seconds, 10 seconds, . . . 55 seconds, and 0 seconds) to display the month (January to December). The minute hand and the hour hand point at one of the 12-o'clock position, the 1-o'clock position, the 2-o'clock position, and the 3-o'clock position to display the years (0 to 3 years) elapsed since a leap year.

In the timepiece described in JP-A-2000-147157, when the calendar display mode is set, all the hour hand, the minute hand, and the second hand need to be moved to display the month and the years elapsed since a leap year (hereinafter also simply referred to as elapsed years). It therefore undesirably takes time to display the month and the elapsed years.

SUMMARY

An advantage of some aspects of the invention is to provide an electronic timepiece capable of quickly displaying the years elapsed since a leap year and calendar information different from the elapsed years and a method for correcting the calendar of the electronic timepiece.

An electronic timepiece according to an aspect of the invention includes an indicating hand, a dial having a display area provided with a plurality of markings corresponding to the indicating hand, and a display controller that controls driving operation of the indicating hand to cause the indicating hand to display calendar information. The display area, when viewed from a timepiece front side, is divided by two straight lines that pass through a rotating shaft of the indicating hand and are perpendicular to each other into four divided areas. Each of the divided areas is related, as first calendar information, to years elapsed since a leap year, and each of the markings is related to second calendar information. The display controller, when causing the indicating hand to display the calendar information, causes the indicating hand to point at one of the markings in one of the four divided areas to display the elapsed years and the second calendar information.

In general, the display controller causes the indicating hand to display, for example, time information. When a calendar display mode is set, the display controller causes the indicating hand to point at a marking in one of the four divided areas to display the elapsed years and the second calendar information. The second calendar information is, for example, the month, date, or day.

For example, when the display area is provided with 60 markings that divide the full circle into 60 portions, each of the divided areas has 15 markings. The display controller, when it causes the indicating hand to display the elapsed years and, for example, the month, causes the indicating hand to point at, for example, among the markings in the divided area related to 0 years, the first marking counted from the base end in the direction in which the indicating hand rotates to display 0 years and January and causes the indicating hand to point at the second marking to display 0 years and February. Similarly, the display controller causes the indicating hand to point at the third to twelfth markings to display 0 years and March to December. The display controller, when similarly using the indicating hand to display any of 1 year to 3 years, also causes the indicating hand to point at a marking in the corresponding divided area to display the elapsed years and the month.

As a result, since the single indicating hand can be used to display both the elapsed years and the second calendar information, the period required to move the indicating hand to display the elapsed years and the second calendar information can be shortened as compared, for example, with a case where an indicating hand that points at the elapsed years differs from an indicating hand that points at the second calendar information. Further, electric power consumed to display the calendar information can be lowered.

Since the elapsed years and the second calendar information can be simultaneously displayed, the display operation can be simplified and the elapsed years and the second calendar information can be quickly displayed as compared, for example, with a case where after the calendar display mode is set, an operation section of the electronic timepiece is operated to switch displayed information between the elapsed years and the second calendar information.

In the electronic timepiece according to the aspect of the invention, it is preferable that the second calendar information is a month.

In an electronic timepiece, a user typically sets the calendar information by operating the operation section of the electronic timepiece with the calendar information displayed.

To set the calendar information, the user typically sets the elapsed years and subsequently sets the month. In view of this procedure, simultaneously displaying the elapsed years and the month allows the user to readily set the calendar information.

In the electronic timepiece according to the aspect of the invention, it is preferable that the second calendar information is a day or a date.

In the case where the second calendar information is the day, the display controller causes the indicating hand to point at, among the markings in each of the divided areas, one of the first to seventh markings counted from the base end in the direction in which the indicating hand rotates to display the day.

In the case where the second calendar information is the date, each of the divided areas is provided with, for example, 31 markings. The display controller then causes the indicating hand to point at one of the 31 markings in any of the divided areas to display the date.

According to the aspect of the invention with this configuration, the user can check the elapsed years and the day or the date at the same time.

In the electronic timepiece according to the aspect of the invention, it is preferable that the indicating hand is a second hand.

The second hand, which is longer than the hour hand and the minute hand in many cases, allows the user to readily know which marking at which the indicating hand is pointing. Therefore, using the second hand to point at the elapsed years and the second calendar information allows the elapsed years and the second calendar information to be displayed in a clearly understandable manner.

It is preferable that the electronic timepiece according to the aspect of the invention further includes a calendar wheel, and the display controller preferably controls driving operation of the calendar wheel to cause the calendar wheel to display third calendar information.

According to the aspect of the invention with this configuration, since the indicating hand and the calendar wheel can be used to display two types of calendar information (two of the month, day, and date) as well as the elapsed years at the same time, the usability of the electronic timepiece can be improved.

It is preferable that the electronic timepiece according to the aspect of the invention further includes a second indicating hand that differs from the indicating hand as a first indicating hand, and the display controller, when causing the first indicating hand to display the calendar information, preferably controls driving operation of the second indicating hand to cause the second indicating hand to point at one of the markings to display third calendar information.

According to the aspect of the invention with this configuration, since the first indicating hand and the second indicating hand can be used to display two types of calendar information as well as the elapsed years at the same time, the usability of the electronic timepiece can be improved. Further, using an indicating hand that displays, for example, time information as the second indicating hand eliminates a need to provide a dedicated part for displaying the third calendar information, such as the calendar wheel.

A method for correcting a calendar of an electronic timepiece according to another aspect of the invention is a method for correcting a calendar of an electronic timepiece including an indicating hand, a dial having a display area provided with a plurality of markings corresponding to the indicating hand, and an operation section, the display area, when viewed from a timepiece front side, divided by two straight lines that pass through a rotating shaft of the indicating hand and are perpendicular to each other into four divided areas, each of the divided areas related, as first calendar information, to years elapsed since a leap year, each of the markings related to second calendar information, and when the indicating hand is used to display the calendar information, the indicating hand is caused to point at one of the markings in one of the four divided areas to display the elapsed years and the second calendar information, and the method includes correcting the elapsed years by causing the indicating hand to point at one of the four divided areas in accordance with operation performed on the operation section and correcting, after the correcting of the elapsed year, a month by causing the indicating hand to point at one of the markings in one of the divided areas in accordance with operation performed on the operation section.

According to the aspect of the invention, the user operates the operation section to select one of the four divided areas and cause the indicating hand to point at the selected divided area to correct the elapsed years, and then operates the operation section to select one of the markings in the selected divided area and cause the indicating hand to point at the selected marking to correct the month. The operation described above allows easier selection of a marking, for example, than in a case where one of the markings provided on the display area is selected and the indicating hand is caused to point at the selected marking to simultaneously correct the elapsed years and the month, whereby the elapsed years and the month can be readily set.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
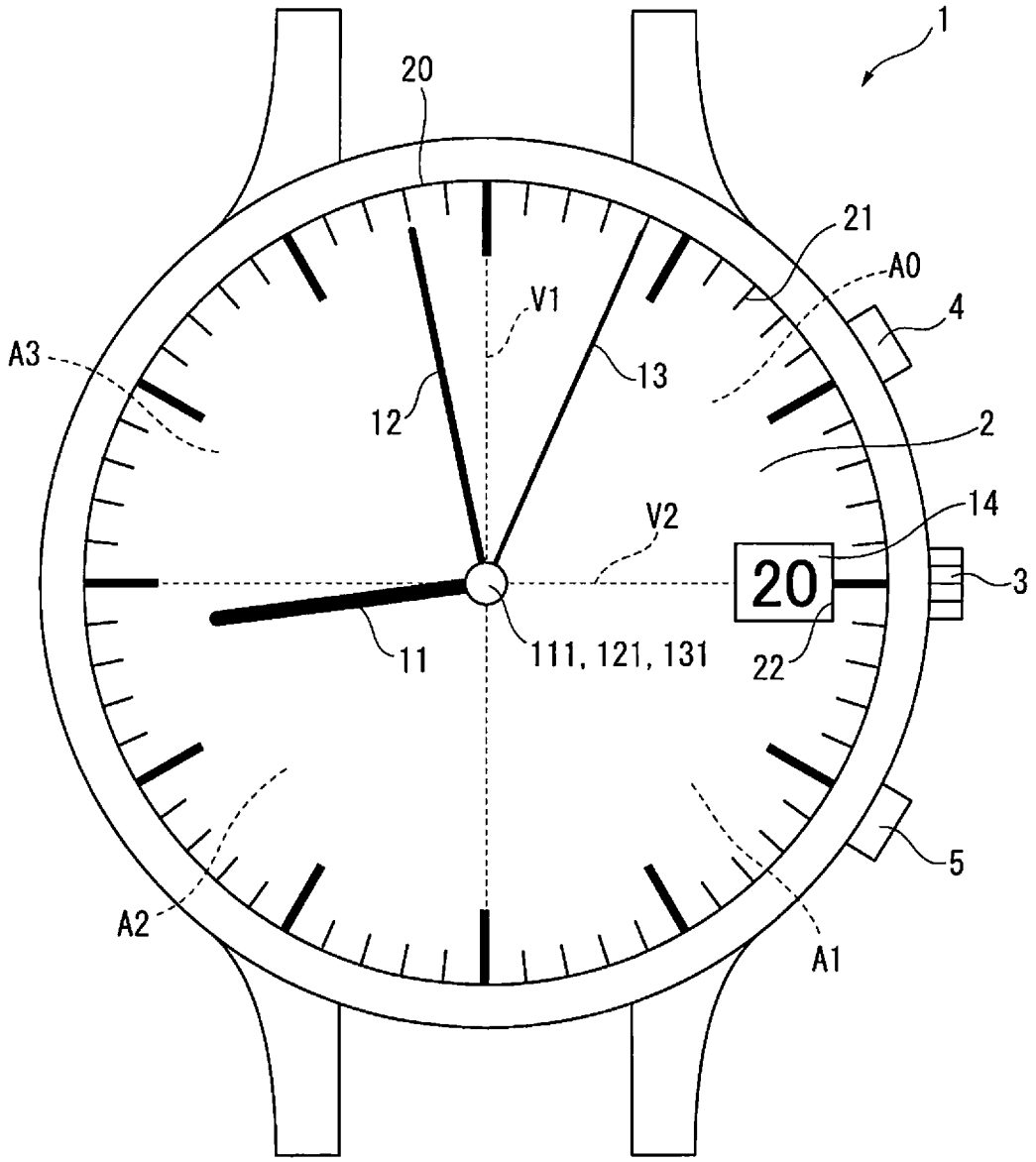
FIG. 1 is a front view of an electronic timepiece according to an embodiment of the invention.

FIG. 1 is a front view showing an electronic timepiece 1 that performs time display in an analog form.

The electronic timepiece 1 includes a disk-shaped dial 2, as shown in FIG. 1. The electronic timepiece 1 further includes an hour hand 11, a minute hand 12, and a second hand 13 (center hand), which display time information. Rotating shafts 111, 121, and 131 of the hour hand 11, the minute hand 12, and the second hand 13 are located at the center of the dial 12.

On the peripheral surface of the dial 2 are written 60 markings 21, which divide the full circle into 60 portions, in correspondence with the second positions from the 0-second position to the 59-second position. The 12 markings 21 provided in the 0-second position and the positions of the seconds that are integer multiples of 5 seconds are so formed as to be longer and wider than the other markings 21. Each of the hour hand 11, the minute hand 12, and the second hand 13 points at a marking 21 to display the hour, minute, and second of the time.

The dial 2, when viewed from the timepiece front side, has a display area 20 surrounded by a line that connects the outer ends of the markings 21 to each other. In the present embodiment, since the markings 21 are provided on the peripheral surface of the dial 2, the entire area of the dial 2 forms the display area 20.

The display area 20, when viewed from the timepiece front side, is divided by two straight lines V1 and V2, which pass through the rotating shafts 111, 121, and 131 and are perpendicular to each other, into four fan-shaped divided areas A0 to A3.

In the present embodiment, the straight line V1 passes through the 12-o'clock position and the 6-o'clock position on the dial 2, and straight line V2 passes through the 3-o'clock position and the 9-o'clock position on the dial 2. The divided area A0 is an area surrounded by the straight line V1, the straight line V2, and the outer circumferential edge of the dial 2 extending from the 12-o'clock position to the 3-o'clock position. The divided area A1 is an area surrounded by the straight line V1, the straight line V2, and the outer circumferential edge of the dial 2 extending from the 3-o'clock position to the 6-o'clock position. The divided area A2 is an area surrounded by the straight line V1, the straight line V2, and the outer circumferential edge of the dial 2 extending from the 6-o'clock position to the 9-o'clock position. The divided area A3 is an area surrounded by the straight line V1, the straight line V2, and the outer circumferential edge of the dial 2 extending from the 9-o'clock position to the 12-o'clock position.

Each of the divided areas A0 to A3 has 15 of the markings 21. That is, the divided area A0 has 15 markings in the positions from the 1-second position to the 15-second position, the divided area A1 has 15 markings in the positions from the 16-second position to the 30-second position, the divided area A2 has 15 markings in the positions from the 31-second position to the 45-second position, and the divided area A3 has 15 markings in the positions from the 46-second position to the 0-second position.

Each of the divided areas A0 to A3 is related to the years (0 to 3 years) elapsed since a leap year as first calendar information. Further, markings 21 in each of the divided areas A0 to A3 are related to the month (January to December) as second calendar information.

When a calendar display mode, which will be described later, is set, the second hand 13 points at a marking 21 in one of the divided areas A0 to A3 to display the elapsed years and the month. The second hand 13 is an indicating hand (first indicating hand) in an aspect of the invention.

Specifically, the second hand 13 points, among the markings 21 in the divided area A0, at the first marking 21 (marking 21 in 1-second position) counted from the base end in the direction in which the second hand 13 rotates (clockwise direction), to display 0 years and January, and the second hand 13 points at the second marking 21 (marking 21 in 2-second position) to display 0 years and February. Similarly, the second hand 13 points at the third to twelfth markings 21 to display 0 years and March to December. Similarly, to display 1 year to 3 years, the second hand 13 points at a marking 21 in the corresponding divided area to display the elapsed years and the month.

The example shown in FIG. 1 is a display example in the case where the calendar display mode is set, and the second hand 13 points at the fourth marking 21 in the divided area A0 (marking 21 in 4-second position) to display a situation in which the elapsed years are 0 years and the month is April.

Figure 2:
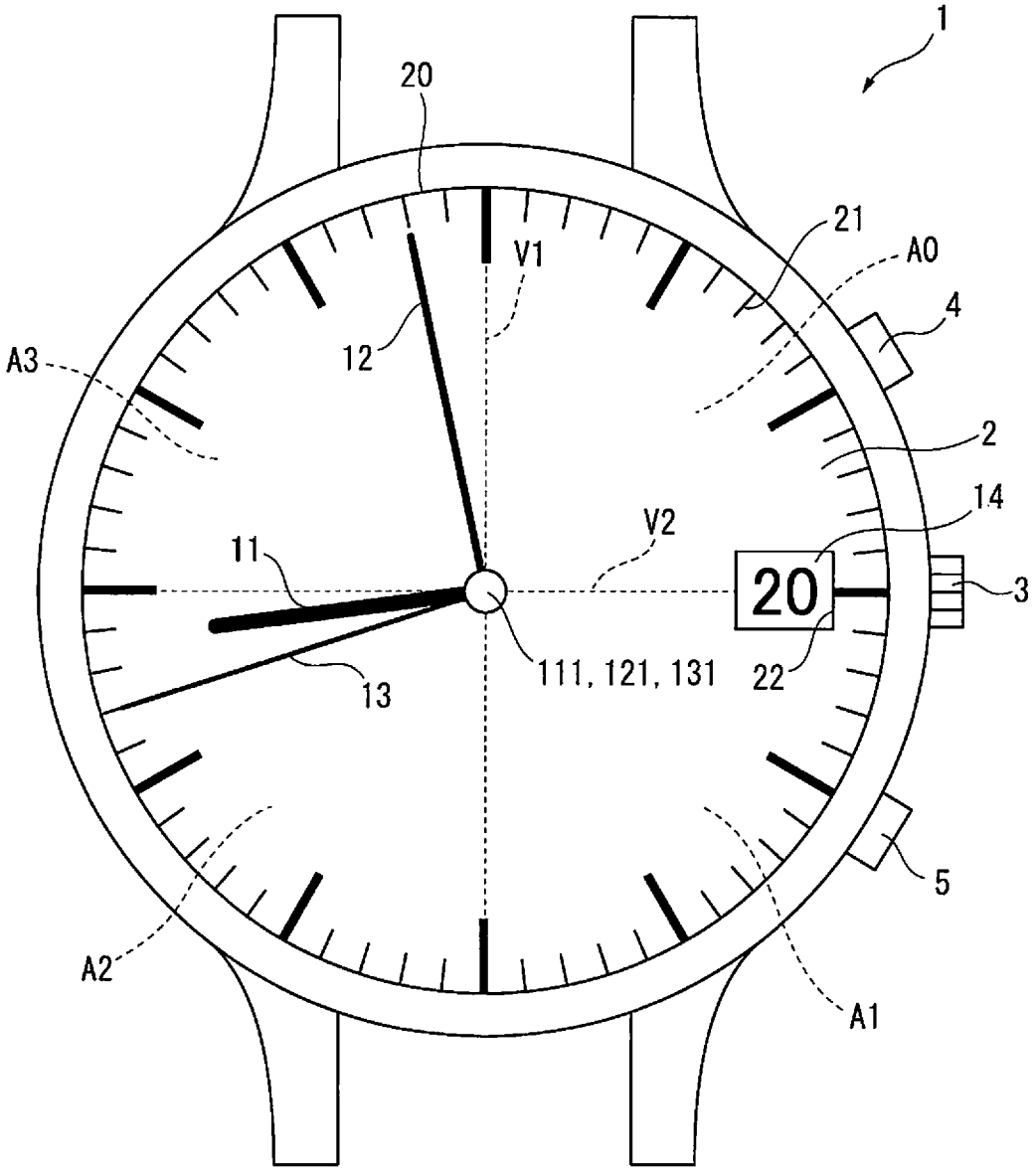
FIG. 2 shows another display example of the electronic timepiece according to the embodiment.

FIG. 2 shows another display example of the electronic timepiece 1, and the second hand 13 points at the twelfth marking 21 in the divided area A2 (marking 21 in 42-second position) to display a situation in which the elapsed years are 2 years and the month is December.

The electronic timepiece 1 further includes a date indicator 14, which displays the date, as a calendar wheel that displays third calendar information. A date window 22, which allows the date written on the date indicator 14 (1-st to 31-th) to be visible, is provided in the 3-o'clock position on the dial 2.

The electronic timepiece 1 is further provided with a crown 3, an A button 4, and a B button 5 as an operation section.

Figure 3:
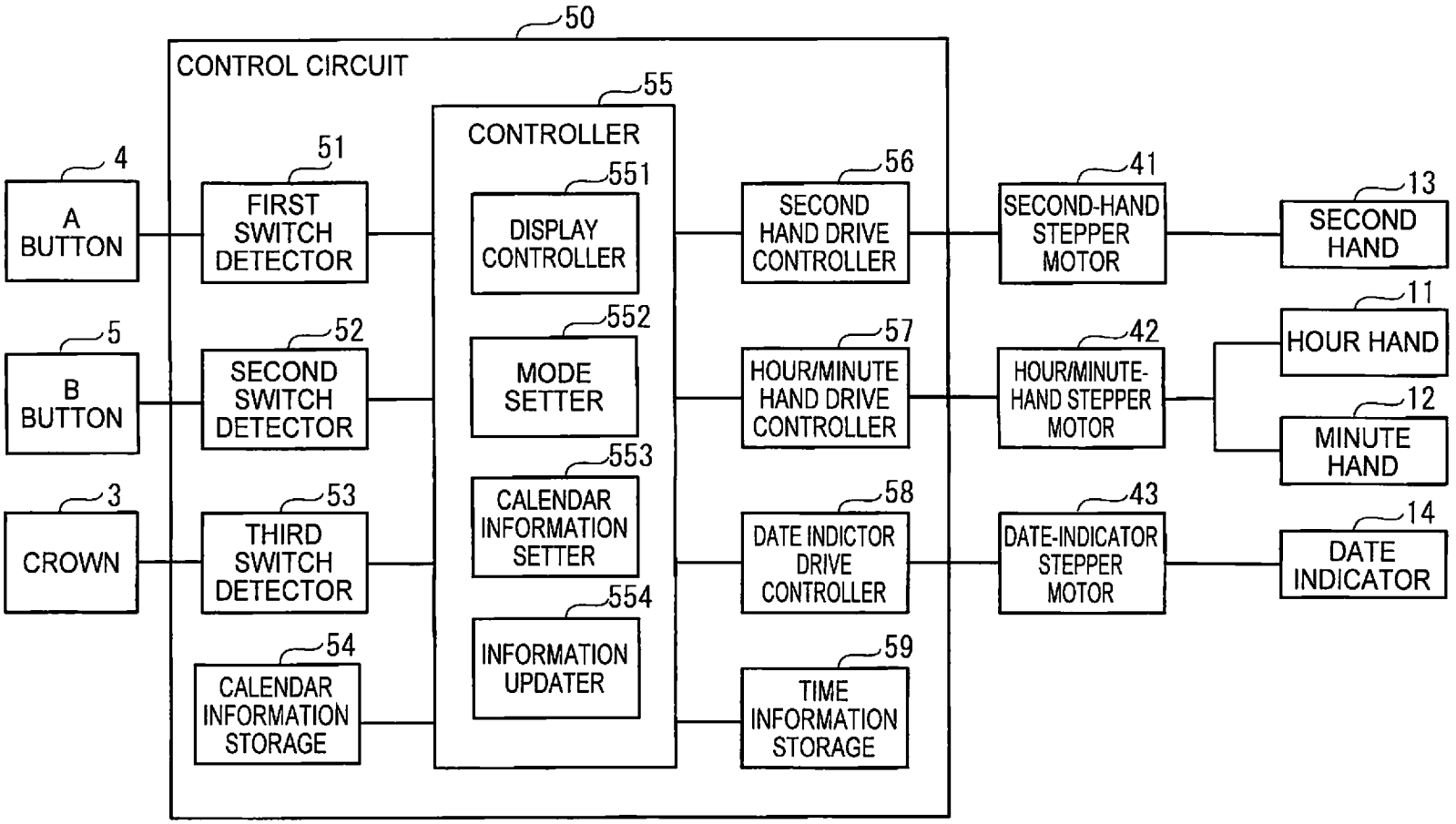
FIG. 3 is a block diagram showing the configuration of the electronic timepiece according to the embodiment.

FIG. 3 is a block diagram showing the configuration of the electronic timepiece 1.

The electronic timepiece 1 includes three stepper motor 91 to 43, which drive the indicating hands 11 to 13 and the date indicator 14, and a control circuit 50, as shown in FIG. 3.

The second hand 13 is driven by the second-hand stepper motor 41, the hour hand 11 and the minute hand 12 are driven by the hour/minute-hand stepper motor 42, and the date indicator 14 is driven by the date-indicator stepper motor 43. Instead, the second hand 13 and the minute hand 12 may be driven by a common stepper motor, and the hour hand 11 and the date indicator 14 may be driven by another common stepper motor.

The control circuit 50 includes a first switch detector 51, a second switch detector 52, a third switch detector 53, a calendar information storage 54, a time information storage 59, a controller 55, a second hand drive controller 56, an hour/minute hand drive controller 57, and a date indicator drive controller 58. The controller 55, which carries out a variety of processes in the electronic timepiece 1, includes a display controller 551, a mode setter 552, a calendar information setter 553, and an information updater 554.

The first switch detector 51 detects operation of pushing the A button 4 and outputs a detection signal to the controller 55 when the pushing operation is detected.

The second switch detector 52 detects operation of pushing the B button 5 and outputs a detection signal to the controller 55 when the pushing operation is detected.

The third switch detector 53 detects operation of pulling or rotating the crown 3 and outputs a detection signal according to the operation to the controller 55 when the pushing or rotating operation is detected.

The display controller 551 controls the second hand drive controller 56, the hour/minute hand drive controller 57, and the date indicator drive controller 58 to drive the stepper motors 41 to 43 to move (drive) the indicating hands 11 to 13 and the date indicator 14. A method for moving the indicating hands 11 to 13 and the date indicator 14 will be described in detail in the description of a calendar display control process, which will be described later.

The second hand drive controller 56 outputs motor drive pulses in accordance with a control signal outputted from the controller 55 to control the second-hand stepper motor 41 to control the driving operation of the second hand 13.

The hour/minute hand drive controller 57 outputs motor drive pulses in accordance with a control signal outputted from the controller 55 to control the hour/minute-hand stepper motor 42 to control the driving operation of the hour hand 11 and the minute hand 12.

The date indicator drive controller 58 outputs motor drive pulses in accordance with a control signal outputted from the controller 55 to control the date-indicator stepper motor 43 to control the driving operation of the date indicator 14.

In a normal mode in which the hour, minute, and second and the date are displayed, the mode setter 552 sets the calendar display mode when the mode setter 552 detects that the A button 4 has been pressed.

The calendar information storage 54 stores, as the calendar information, date information representing the current date, month information representing the current month, and elapsed year information representing the current elapsed years.

The time information storage 59 stores, as the time information, hour information representing the current hour, minute information representing the current minute, and second information representing the current second.

The calendar information setter 553 sets the calendar information stored in the calendar information storage 54 in the calendar display control process, which will be described later and in which the calendar information is also corrected.

The information updater 554 uses a reference signal outputted from a reference signal generation circuit to measure the time and updates the calendar information stored in the calendar information storage 54 and the time information stored in the time information storage 59 in accordance with the elapsed time.

Calendar Display Control Process

In the normal mode, the display controller 551 controls the second hand drive controller 56, the hour/minute hand drive controller 57, and the date indicator drive controller 58 on the basis of the time information stored in the time information storage 59 to cause the hour hand 11, the minute hand 12, and the second hand 13 to display the current hour, minute, and second and the date indicator 14 to display the current date.

When the A button 4 is pressed in the normal mode, the mode setter 552 sets the calendar display mode, in which the calendar display control process is carried out.

During the period for which the calendar display control process is carried out, the hour hand 11 and the minute hand 12 keep displaying the current hour and minute, and the date indicator 14 keeps displaying the current date.

Figure 4:
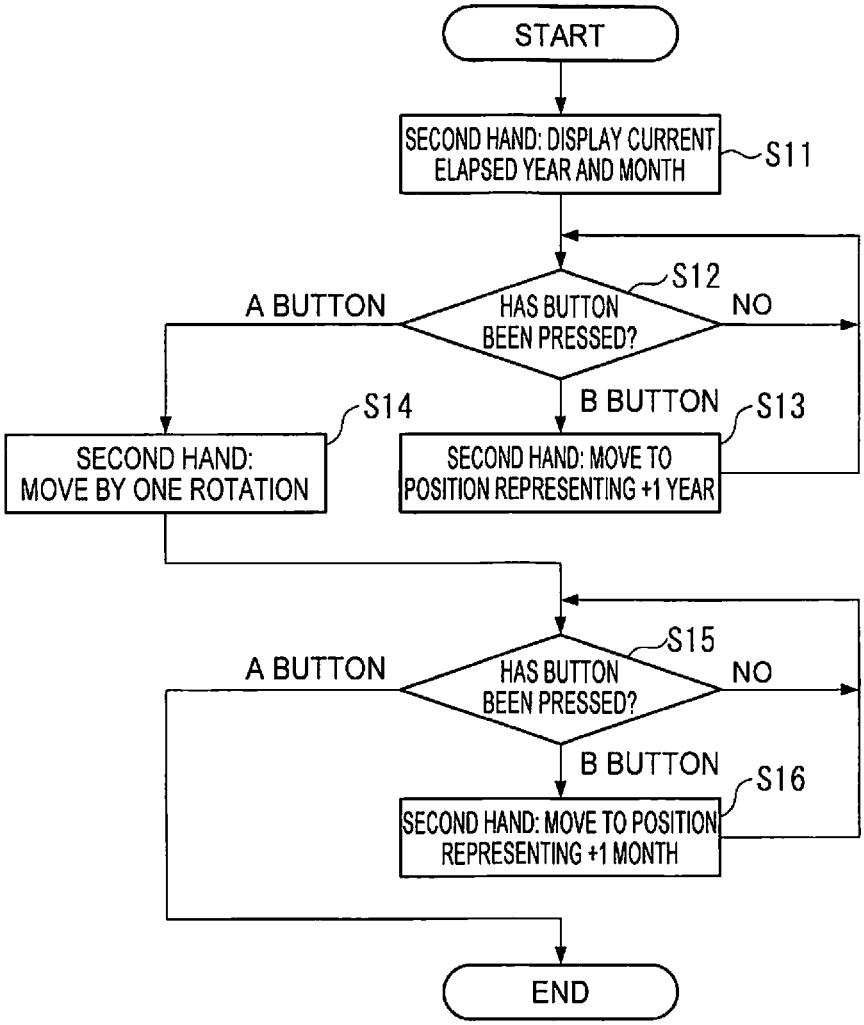
FIG. 4 is a flowchart showing a calendar display control process according to the embodiment.
Figure 5:
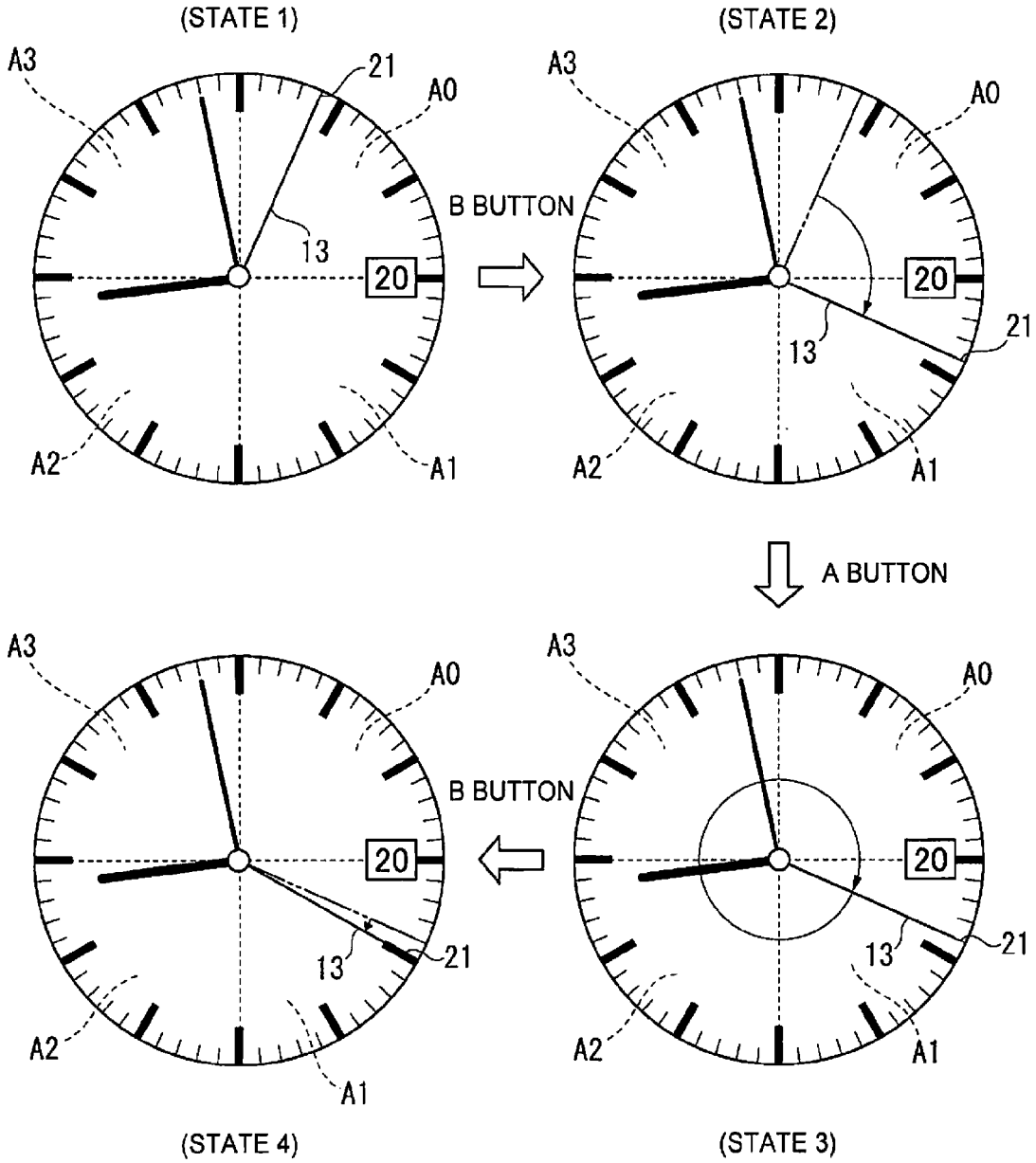
FIG. 5 is a transition diagram showing display states in the electronic timepiece according to the embodiment.

FIG. 4 is a flowchart showing the calendar display control process. FIG. 5 is a transition diagram showing display states in the calendar display control process.

When the calendar display control process is carried out, the display controller 551 moves the second hand 13 at high speed and causes the second hand 13 to point at a marking 21 in one of the divided areas A0 to A3, as shown in a state 1 in FIG. 5, to display the elapsed years and the month stored in the calendar information storage 54 (S11), as shown in FIG. 4.

In the example shown in the state 1 in FIG. 5, the second hand 13 points at the fourth marking 21 in the divided area A0 to display a situation in which the elapsed years are 0 years and the month is April.

The mode setter 552 then sets a year correction mode in which the elapsed years are corrected. The display controller 551 then evaluates whether the A button 4 or the B button 5 has been pressed (S12). The evaluation process in S12 continues until the A button 4 or the B button 5 is pressed. When a preset period elapses without the button 4 or 5 pressed, the mode setter 552 may instead terminate the year correction mode and cause the display mode to return to the normal mode.

When a result of the evaluation in S12 shows that the B button 5 has been pressed, the display controller 551 moves the second hand 13 clockwise at high speed by 90 degrees (by the amount corresponding to 15 markings) to cause the second hand 13 to point at the following divided area, as shown in a state 2 in FIG. 5. As a result, the elapsed years are so corrected to be incremented by 1 year, and the elapsed years having been incremented by 1 year are displayed (S13: year correction step).

In the example shown in the state 2 in FIG. 5, the second hand 13 having pointed at 0 years and April rotates clockwise by 90 degrees to point at the fourth marking 21 in the divided area A1 (marking 21 in 19-second position) to display 1 year and April.

The display controller 551 then returns to the process in S12. The display controller 551 thus advances the elapsed years displayed by the second hand 13 by 1 year whenever the B button 5 is pressed until the A button 4 is pressed. That is, in a case where the previous elapsed years are 0 years, 1 year, or 2 years, the elapsed years advance to 1 year, 2 years, or 3 years, respectively, when the B button 5 is pressed, whereas in a case where the previous elapsed years are 3 years, the elapsed years advance to 0 years when the B button 5 is pressed. The user can thus make the correction in which the elapsed years advance by 1 year by pressing the B button 5.

On the other hand, when a result of the evaluation in S12 shows that the A button 4 has been pressed, the display controller 551 moves the second hand 13 clockwise by one rotation (360 degrees) (S14), as shown in a state 3 in FIG. 5. The user is thus notified that the year correction mode is switched to a month correction mode in which the month is corrected. The mode setter 552 terminates the year correction mode and sets the month correction mode.

When the month correction mode is set, the display controller 551 evaluates whether the button 4 or 5 has been pressed (S15). The evaluation process in S15 continues until the A button 4 or the B button 5 is pressed. When a preset period elapses without the button 4 or 5 pressed, the mode setter 552 may instead terminate the month correction mode and cause the display mode to return to the normal mode.

When a result of the evaluation in S15 shows that the B button 5 has been pressed, the display controller 551 moves the second hand 13 clockwise to cause the second hand 13 to point at the following marking 21, as shown in a state 4 in FIG. 5. As a result, the month is so corrected to be incremented by one month, and the month having been incremented by one month is displayed (S16: month correction step).

In the example shown in the state 4 in FIG. 5, the second hand 13 having pointed at 1 year and April rotates clockwise by 6 degrees to point at the fifth marking 21 in the same divided area A1 (marking 21 in 20-second position) to display 1 year and May.

The display controller 551 then returns to the process in S15. The display controller 551 thus advances the month displayed by the second hand 13 by one month whenever the B button 5 is pressed until the A button 4 is pressed. That is, in a case where the month at which the second hand 13 pointed before the movement is any of January to November, the second hand 13 rotates clockwise by 6 degrees to point at the corresponding one of February to December when the B button 5 is pressed, whereas when the month at which the second hand 13 pointed before the movement is December, the second hand 13 moves clockwise at high speed, passes through the other three divided areas, and points at January in the same divided area before the movement when the B button 5 is pressed. In this case, when the second hand 13 can reverse, the second hand 13 may move counterclockwise from the position representing December to the position representing January. The user can thus make the correction in which the month advances by one month by pressing the B button 5.

On the other hand, when a result of the evaluation in S15 shows that the A button has been pressed, the elapsed years and the month are finalized, and the calendar information setter 553 sets the calendar information stored in the calendar information storage 54 on the basis of the finalized elapsed years and month.

The mode setter 552 then causes the month correction mode to return to the normal mode, and the calendar display control process is completed. When the display mode returns to the normal mode, the display controller 551 moves the second hand 13 to cause it to display the current second.

Correction of the date displayed by the date indicator 14 can be made, for example, by pulling the crown 3 out to a first click position and rotating the crown 3.

Further, correction of the hour, minute, and second displayed by the hour hand 11, the minute hand 12, and the second hand 13 can be made by pulling the crown 3 out to a second click position and rotating the crown 3 in a state in which the second hand 13 is set in the 0-second position.

Advantageous Effects of Embodiment

Since the second hand 13 can be used to display both the elapsed years and the month, the period required to move the indicating hand to display the elapsed years and the month can be shortened as compared, for example, with the case where an indicating hand that points at the elapsed years differs from an indicating hand that points at the month. Further, electric power consumed to display the calendar information can be lowered.

Since the elapsed years and the month can be simultaneously displayed, the display operation can be simplified and the elapsed years and the month can be quickly displayed as compared, for example, with a case where after the calendar display mode is set, the buttons A and B, the crown 3, and other operation components are operated to switch displayed information between the elapsed years and the month.

To set the calendar information, the user sets the elapsed years and subsequently sets the month. In view of this procedure, simultaneously displaying the elapsed years and the month allows the user to readily set the calendar information.

Further, no dedicated indicating hand or stepper motor for displaying the elapsed years and the month is required, whereby the number of indicating hands and stepper motors provided in the electronic timepiece 1 can be reduced.

In a case where the display area 20 is divided into 12 areas instead of the 4 areas so that the months are related to the 12 divided areas and the elapsed years are related to the markings 21 in each of the divided areas, the second hand 13 points at a marking 21 in a different divided area whenever the month advances to display the elapsed years. Since the elapsed years change once a year, if the second hand 13 points at a marking in a different divided area whenever the month advances to display the elapsed years, the displayed elapsed years may be difficult to understand in some cases. In contrast, according to the present embodiment, in which the second hand 13 points at the same divided area throughout one year to display the elapsed years, the elapsed years can be displayed in a clearly understandable manner.

In the calendar display control process, the user presses the B button 5, in the state in which the year correction mode is set, to select one of the divided areas A0 to A3 and cause the second hand 13 to point at the selected divided area to correct the elapsed years, and then presses the A button 4 to switch the year correction mode to the month correction mode, presses the B button 5 to select one of the 12 markings 21 in the selected divided area and cause the second hand 13 to point at the selected marking 21 to correct the month. The calendar display control process allows easier selection of a marking 21, for example, than in a case where one of the 60 markings 21 is selected and the second hand 13 is caused to point at the selected marking 21 to simultaneously correct the elapsed years and the month, whereby the elapsed years and the month can be readily set.

The second hand 13, which is longer than the hour hand 11 and the minute hand 12, allows the user to readily know which marking 21 at which the indicating hand is pointing. Therefore, using the second hand 13 to point at the elapsed years and the month allows the elapsed years and the month to be displayed in a clearly understandable manner.

Other Embodiments

The invention is not limited to the embodiment described above, and changes, improvement, and other modifications to the extent that the advantage of some aspects of the invention is achieved fall within the scope of the invention.

In the embodiment described above, the second hand 13 displays the month as the second calendar information when the calendar display mode is set, but the invention is not necessarily configured this way. For example, the second hand 13 may display the day or the date as the second calendar information.

In the case where the second hand 13 is used to display the day, the display controller 551 causes the second hand 13 to point at, among the markings 21 in each of the divided areas, one of the first to seventh markings 21 counted from the base end in the direction in which the second hand 13 rotates to display the day. The start day related to the first marking 21 may be set as appropriate to be, for example, Sunday or Monday.

In the case where the second hand 13 is used to display the date, for example, the following markings are provided on the dial: two markings between the marking 21 in the 14-second position and the marking 21 in the 15-second position; two markings between the marking 21 in the 29-second position and the marking 21 in the 30-second position; two markings between the marking 21 in the 44-second position and the marking 21 in the 45-second position; and two markings between the marking 21 in the 59-second position and the marking 21 in the 0-second position in such a way that each of the space between the markings 21 described above is divided into three portions, and one marking is further provided on the dial 2 between the other markings in such a way that each of the space between the other markings into two portions. As a result, 31 markings in total are provided in each of the divided areas A0 to A3. The display controller then causes the second hand 13 to point at one of the 31 markings in one of the divided areas to display the date.

The display controller 551 may instead, when the calendar display mode is set, cause the second hand 13 to display the month or the day or display the month or the date switched from one to the other in accordance with operation performed on the buttons 4 and 5, the crown 3, and other operation components.

In the embodiment described above, when the calendar display mode is set, the second hand 13 is used to display the first calendar information and the second calendar information, but the invention is not necessarily configured this way. For example, the hour hand 11 or the minute hand 12 may be used to display the first calendar information and the second calendar information. Further, when the electronic timepiece has a chronograph function of measuring a period, a ⅕-second chronograph hand or a minute chronograph hand may be used to display the first calendar information and the second calendar information.

To display the elapsed years and the month in a clearly understandable manner, however, among the indicating hands that can be used to point at the markings 21, an indicating hand having the greatest length dimension (second hand 13 in the embodiment described above) is preferably used to display the first calendar information and the second calendar information.

In the embodiment described above, the date indicator 14 is used to display the date as the third calendar information, but the invention is not necessarily configured this way. For example, a day indictor, which displays the day, or a month indicator, which displays the month, may be used to display the day or the month as the third calendar information.

In the embodiment described above, the date indicator 14 as a calendar wheel is used to display the third calendar information, but the invention is not necessarily configured this way. For example, the hour hand 11 or the minute hand 12 may be used to display the third calendar information. In this case, the hour hand 11 or the minute hand 12 corresponds to a second indicating hand in an aspect of the invention.

When the minute hand 12 is used to display the date, the display controller 551 causes the minute hand 12 to point at the corresponding one of the markings 21 representing 1 to 31 minutes to display the 1-st to the 31-th date. The date can thus be displayed in a clearly understandable manner without provision of dedicated markings for displaying the date.

Instead, the calendar wheel may be used to display the third calendar information, and the hour hand 11 or the minute hand 12 may be used to display the month, the date, or the day as fourth calendar information. In this case, the elapsed years, the month, the date, and the day can be simultaneously displayed.

In the embodiment described above, the calendar display control process is carried out when the A button 4 is pressed and then terminated when the A button 4 is pressed twice, but the invention is not necessarily configured this way. For example, the calendar display control process may be carried out and then immediately terminated when the crown 3 is operated. In this case, when the user only checks the elapsed years and the month but does not correct them, the user can check the elapsed years and the month in S11 and then operate the crown to immediately terminate the calendar display control process.

In the embodiment described above, the dial 2 is formed in a disk-like shape, but the invention is not necessarily configured this way. For example, the dial 2 may be formed in a rectangular shape or an elliptical shape when viewed from the timepiece front side.

In the embodiment described above, the rotating shafts 111, 121, and 131 of the indicating hands 11 to 13 are located at the center of the dial 2, but the invention is not necessarily configured this way. For example, the rotating shafts 111, 121, and 131 may be so located as to be shifted from the center of the dial 2 toward the periphery thereof, and the markings 21 may be arranged around the area where the indicating hands 11 to 13 rotate.

In the embodiment described above, in the calendar display control process, when a result of the evaluation in S15 shows that the A button 4 has been pressed, the elapsed years and the month are finalized, and the calendar display control process is terminated, but the invention is not necessarily configured this way. For example, when a result of the evaluation in S15 shows that the A button 4 has been pressed, date correction may be subsequently performed with the second hand 13 displaying the elapsed years and the month. In this case, for example, the date is corrected, and after the A button 4 is pressed again, the elapsed years, the month, and the date are finalized.

The entire disclosure of Japanese Patent Application No. 2015-128504, filed Jun. 26, 2015 is expressly incorporated by reference herein.

What is claimed is:

1. An electronic timepiece comprising:

an indicating hand;

a dial having a display area provided with a plurality of markings corresponding to the indicating hand; and a display controller that controls driving operation of the indicating hand to cause the indicating hand to display calendar information, wherein the display area, when viewed from a timepiece front side, is divided by two straight lines that pass through a rotating shaft of the indicating hand and are perpendicular into divided area, one of the divided areas is related, as first calendar information, to years elapsed since a leap year, each of the marking is related to second calendar information, and the display controller, when causing the indicating hand to display the calendar information, causes the indicating hand to point at one of the markings in one of the four divided areas to display the elapsed years and the second calendar information.

2. The electronic timepiece according to claim 1, wherein the second calendar information is a month.

3. The electronic timepiece according to claim 1, wherein the second calendar information is a day or a date.

4. The electronic timepiece according to claim 1, wherein the indicating hand is a second hand.

5. The electronic timepiece according to claim 1, further comprising a calendar wheel, wherein the display controller controls driving operation of the calendar wheel to cause the calendar wheel to display third calendar information.

6. The electronic timepiece according to claim 1, further comprising a second indicating hand that differs from the indicating hand as a first indicating hand, wherein the display controller, when causing the first indicating hand to display the calendar information, controls driving operation of the second indicating hand to cause the second indicating hand to point at one of the markings to display third calendar information.

7. A method for correcting a calendar of an electronic timepiece including an indicating hand, a dial having a display area provided with a plurality of markings corresponding to the indicating hand, and an operation section, the display area, when viewed from a timepiece front side, divided by two straight lines that pass through a rotating shaft of the indicating hand and are perpendicular to each other into four divided areas, each of the divided areas related, as first calendar information, to years elapsed since a leap year, each of the markings related to second calendar information, and when the indicating hand is used to display the calendar information, the indicating hand is caused to point at one of the markings in one of the four divided areas to display the elapsed years and the second calendar information, the method comprising:

correcting the elapsed years by causing the indicating hand to point at one of the four divided areas in accordance with operation performed on the operation section; and correcting, after the correcting of the elapsed year, a month by causing the indicating hand to point at one of the markings in one of the divided areas in accordance with operation performed on the operation section.

* * * * *